US008147260B2

(12) United States Patent
Huang

(10) Patent No.: US 8,147,260 B2
(45) Date of Patent: Apr. 3, 2012

(54) POWER OUTLET SOCKET SAFETY SHIELD DEVICE

(76) Inventor: Huadao Huang, Yueqing (CN)

( * ) Notice: Subject to any disclaimer, the term of this patent is extended or adjusted under 35 U.S.C. 154(b) by 0 days.

(21) Appl. No.: 12/868,262

(22) Filed: Aug. 25, 2010

(65) Prior Publication Data

US 2010/0317207 A1 Dec. 16, 2010

Related U.S. Application Data

(63) Continuation-in-part of application No. 12/768,394, filed on Apr. 27, 2010.

(30) Foreign Application Priority Data

Sep. 25, 2009 (CN) ..... 2009 2 0223089

(51) Int. Cl.
*H01R 13/44* (2006.01)

(52) U.S. Cl. ..... 439/140

(58) Field of Classification Search ..... 439/140, 439/135, 137, 139, 143, 145
See application file for complete search history.

(56) References Cited

U.S. PATENT DOCUMENTS 4,544,219 A * 10/1985 Barkas ..... 439/137
7,645,149 B2 * 1/2010 Carbone et al. ..... 439/137
2009/0052120 A1 * 2/2009 Weeks et al. ..... 361/601

* cited by examiner

*Primary Examiner* — Tho D Ta
*Assistant Examiner* — Travis Chambers
(74) *Attorney, Agent, or Firm* — Mei & Mark LLP

(57) ABSTRACT

A power outlet socket safety shield device comprises a left slider comprising a left transverse baffle and a left inclined stopper. A right slider comprises a right transverse baffle and a right inclined stopper. At least one elastic element is positioned between the left slider and the right slider. The left inclined stopper is inclined in a direction opposite to the inclination of the right inclined stopper. When the device is in a rest state, the left inclined stopper is above the right transverse baffle and the right inclined stopper is above the left transverse baffle. When the device is in an active state, the elastic element is compressed, the left slider and the right slider are moved in opposite directions to displace the left inclined stopper away from the right transverse baffle and to displace the right inclined stopper away from the left transverse baffle.

15 Claims, 6 Drawing Sheets

POWER OUTLET SOCKET SAFETY SHIELD DEVICE

This application claims the benefit of priority of Chinese patent application 200920223089.2, filed Sep. 25, 2009, the content of which is incorporated herein by reference in its entirety. This application is a continuation in part of, and claims the benefit of priority to, U.S. patent application Ser. No. 12/768,394 for "Supply Hub Safety Shield," filed Apr. 27, 2010, which claims the benefit of priority to Chinese patent application 200920149748.2, filed Jun. 10, 2009, the contents of which are incorporated herein by reference in their entirety.

TECHNICAL FIELD

The present disclosure relates generally to safety devices for power outlets. A power outlet with one or more power outlet socket safety shield devices installed in the power outlet prevents electroshock casualty accidents caused by touching the conductor through the socket at the surface of the power outlet.

BACKGROUND

Safety is the first concern when people select household electrical products. Currently, the commonly used power outlet is mainly composed of the enclosure and two or three groups of conductive sheet metals installed in it. The conductive sheet metals are known as the "hot," or power livewire output conductive socket group, the "neutral" or power zero wire output conductive socket group and the "ground" or earth wire conductive socket group. At the surface of the power outlet enclosure, there are 2-hole and/or 3-hole power sockets, below which the conductive sheet metals are provided. The conductive sheet metals are connected with the hot, neutral and ground wires in the wall through conductive assemblies and wires, allowing the power sockets on the surface of power outlet to have power output.

The live conductive sheet metals in the power outlet are located below the hollow power sockets on the surface of the enclosure. For this reason, in real life, children may stretch out their fingers into the sockets or touch the conductive sheet metals below the sockets (i.e. power output conductive socket) with fingers or metal bars. Once the children touch the conductive sheet metals in the power sockets, electroshock casualty accidents may occur. This is very dangerous.

SUMMARY

Considering the above, a power outlet socket safety shield device is installed inside the power outlet, which can prevent electroshock casualty accidents caused by touching the conductor that is otherwise accessible in the socket at the surface of power outlet.

When a power plug is not inserted in the power outlet, the power outlet socket safety shield device covers the hot conductive socket and the neutral conductive socket below it, keeping the power sockets in an enclosed state. This can effectively prevent electroshock casualty accidents caused by inserting fingers or metal bars into the power sockets by mistake or for curiosity. When a power plug is inserted into the power sockets by force, under the action of the power plug pins, the power outlet socket safety shield device moves and exposes the hot conductive socket and the neutral conductive socket, allowing the power plug to be inserted into the power outlet.

In one embodiment, a power outlet socket safety shield device comprises a left slider comprising an inside side wall on one end and an outside side wall on an opposite end, the inside wall comprising a left transverse baffle and the outside wall comprising a left inclined stopper. A right slider comprises an inside side wall on one end and an outside side wall on an opposite end, the inside wall comprising a right transverse baffle and the outside wall comprising a right inclined stopper. At least one elastic element is positioned between the left slider and the right slider. The left inclined stopper is inclined in a direction opposite to the inclination of the right inclined stopper. When the power outlet socket safety shield device is in a rest state, the left inclined stopper is above the right transverse baffle and the right inclined stopper is above the left transverse baffle. When the power outlet socket safety shield device is in an active state, the elastic element is compressed, the left slider and the right slider are moved in opposite directions to displace the left inclined stopper away from the right transverse baffle and to displace the right inclined stopper away from the left transverse baffle.

The power outlet socket safety shield device is installed between the hot socket and the neutral socket at the power outlet surface and the hot conductive socket and the neutral conductive socket inside the power outlet. When the power plug is not inserted in the power outlet, the power outlet socket safety shield device covers the hot conductive socket and the neutral conductive socket below it, keeping all the power output sockets at the power outlet surface in an enclosed protective state. In this configuration, it is completely impossible to touch the hot and neutral conductive sockets through the hot and neutral sockets on the upper cover of the power outlet. Even if people insert their fingers or metal bars into the power sockets by mistake or for curiosity, they can not contact the hot conductive socket or neutral conductive socket, and no electroshock accidents will occur. So, the power outlet is very safe.

When a power plug is inserted into the power sockets on the power outlet surface by force, under the action of the power plug pins, the power outlet socket safety shield device in the power outlet moves and exposes the power output conductive sockets under it, allowing the power plug to be inserted into the power outlet. When the power plug is pulled out of the power outlet, under the action of the elastic element in the power outlet socket safety shield device, the power outlet socket safety shield device returns to the initial position. The power outlet socket safety shield device covers the hot conductive socket and the neutral conductive socket below it, reinstating all the power output sockets at the power outlet surface to the enclosed protective state again. Therefore, this utility model can effectively prevent electroshock casualty accidents caused by people inserting their fingers or metal bars into the power sockets by mistake or for curiosity, greatly improving the safety of the power outlet.

The advantages of the power outlet socket safety shield device include a simple structure, a simple manufacturing process, and a low cost. It can effectively prevent electroshock casualty accidents caused by people inserting their fingers or metal bars into the power sockets by mistake or for curiosity. The power outlet and device are very safe.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

Figure 1:
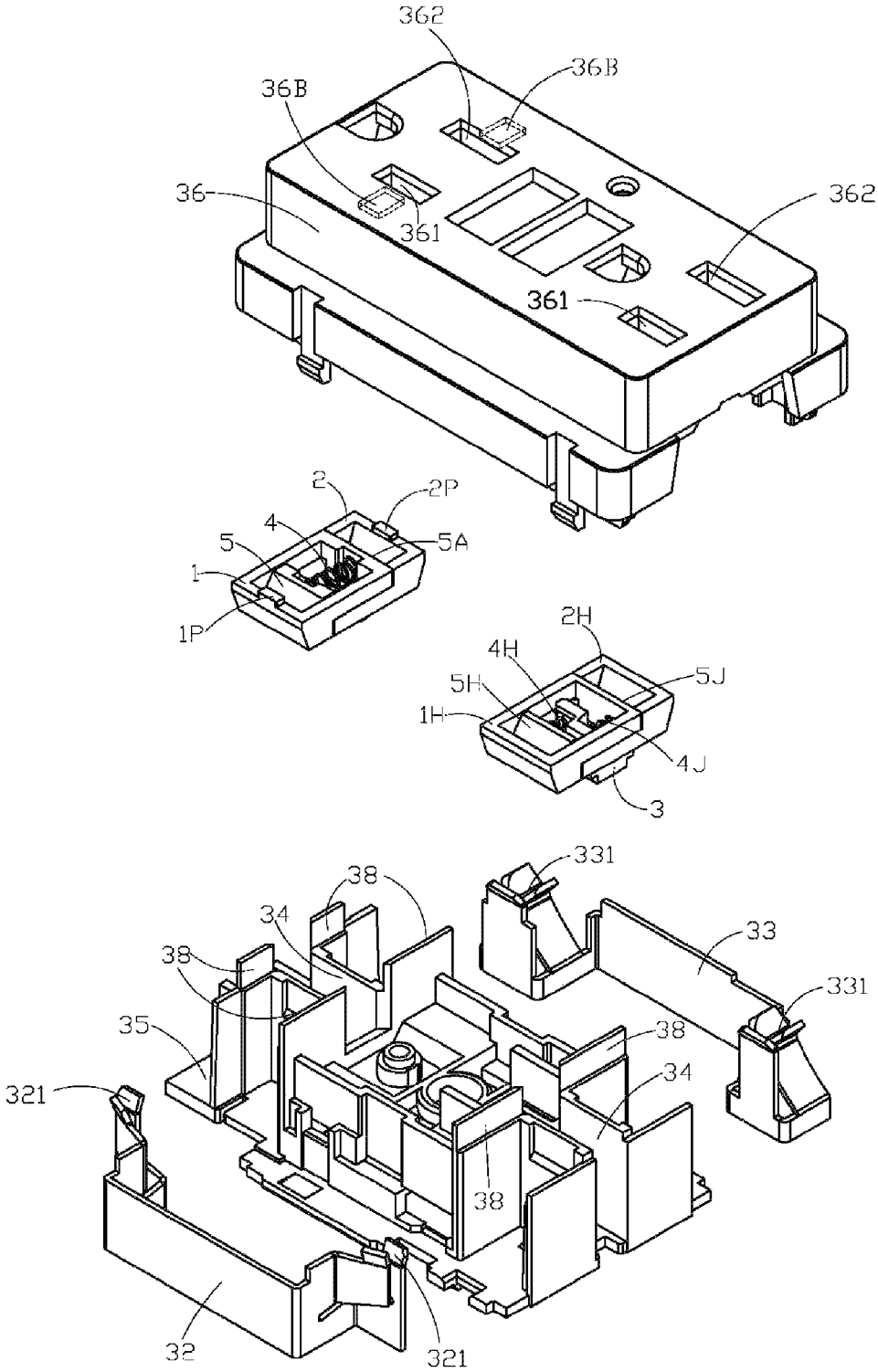
FIG. 1 is an example of a schematic structural diagram of a power outlet with the power outlet socket safety shield device installed.
Figure 2A:
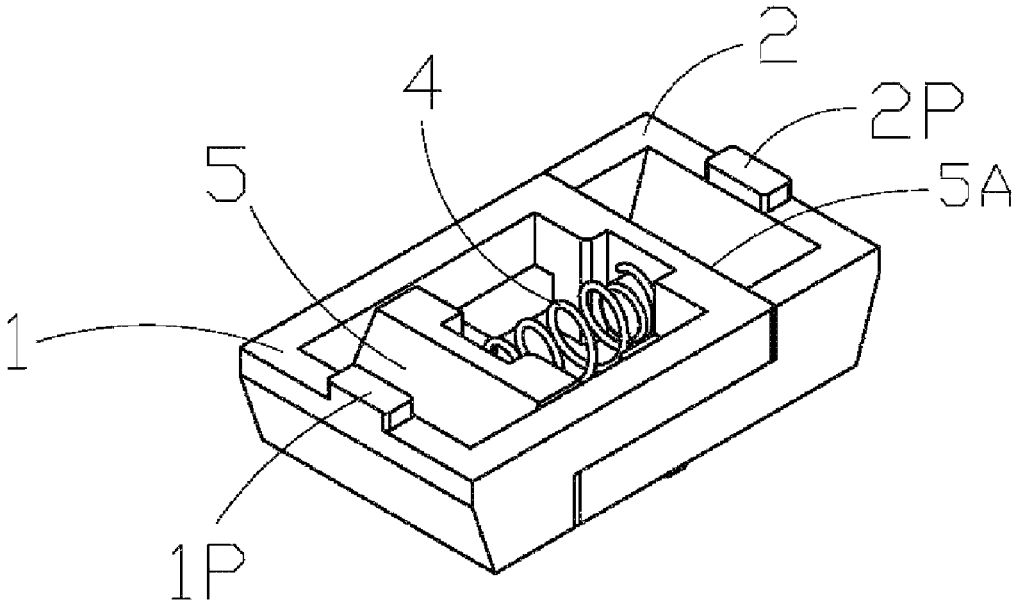
FIG. 2A is an example of a structural diagram of Implementation Example 1 after assembly.
Figure 3A:
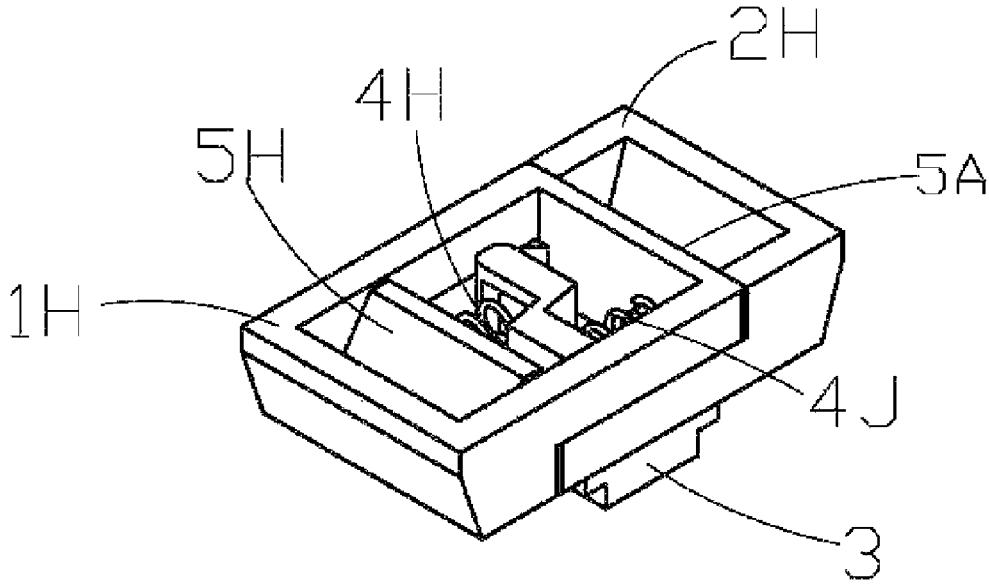
FIG. 3A is an example of a structural diagram of Implementation Example 2 after assembly.

To effectively prevent electroshock casualty accidents caused by unintentional touching of the conductors accessible in the power sockets at the power outlet surface, the power outlet socket safety shield device is installed in a power outlet as shown in FIGS. 2A and 3A. As shown in FIG. 1, this power outlet socket safety shield device (as shown in FIGS. 2A and 3A) is installed between the hot sockets 361 and neutral sockets 362 and the hot conductive socket 321 and the neutral conductive socket 331. When the power plug is not inserted in the power outlet, the power outlet socket safety shield device covers the hot conductive socket 321 and the neutral conductive socket 331 below it, keeping the power sockets in an enclosed state. It is impossible to see or touch the hot and neutral output conductive sockets 321 and 331 through the hot socket 361 and neutral socket 362 on the power outlet surface. Even if a child or adult touches the power sockets or inserts small metal bars into the power sockets, the power outlet socket safety shield device will not be moved. They will not touch the conductors in the sockets, and subsequently no electroshock casualty accidents will occur, guaranteeing safety.

When the power plug is inserted into the power outlet by force, along with its insertion, the power outlet socket safety shield device will act, and the baffles and inclined stoppers of the power outlet socket safety shield device will be moved, exposing the hot conductive socket 321 and neutral conductive socket 331, allowing the power plug to be inserted into the power outlet and supplying power to the power plug. When the power plug is pulled out of the power outlet, under the action of at least one elastic element such as a spring or an elastic sheet metal, the baffles and inclined stoppers of the power outlet socket safety shield device will return to the initial position, covering the hot conductive socket and the neutral conductive socket below it, and reinstating all of the power output sockets to an enclosed protective state again. In this state, it is impossible to see or touch the hot and neutral output conductive sockets through the hot socket and neutral socket on the power outlet surface. Even if a child or adult touches the power sockets or inserts small metal bars into the power sockets unintentionally, they will not touch the conductors in the sockets, and subsequently no electroshock casualty accidents will occur, guaranteeing safety.

Figure 2B:
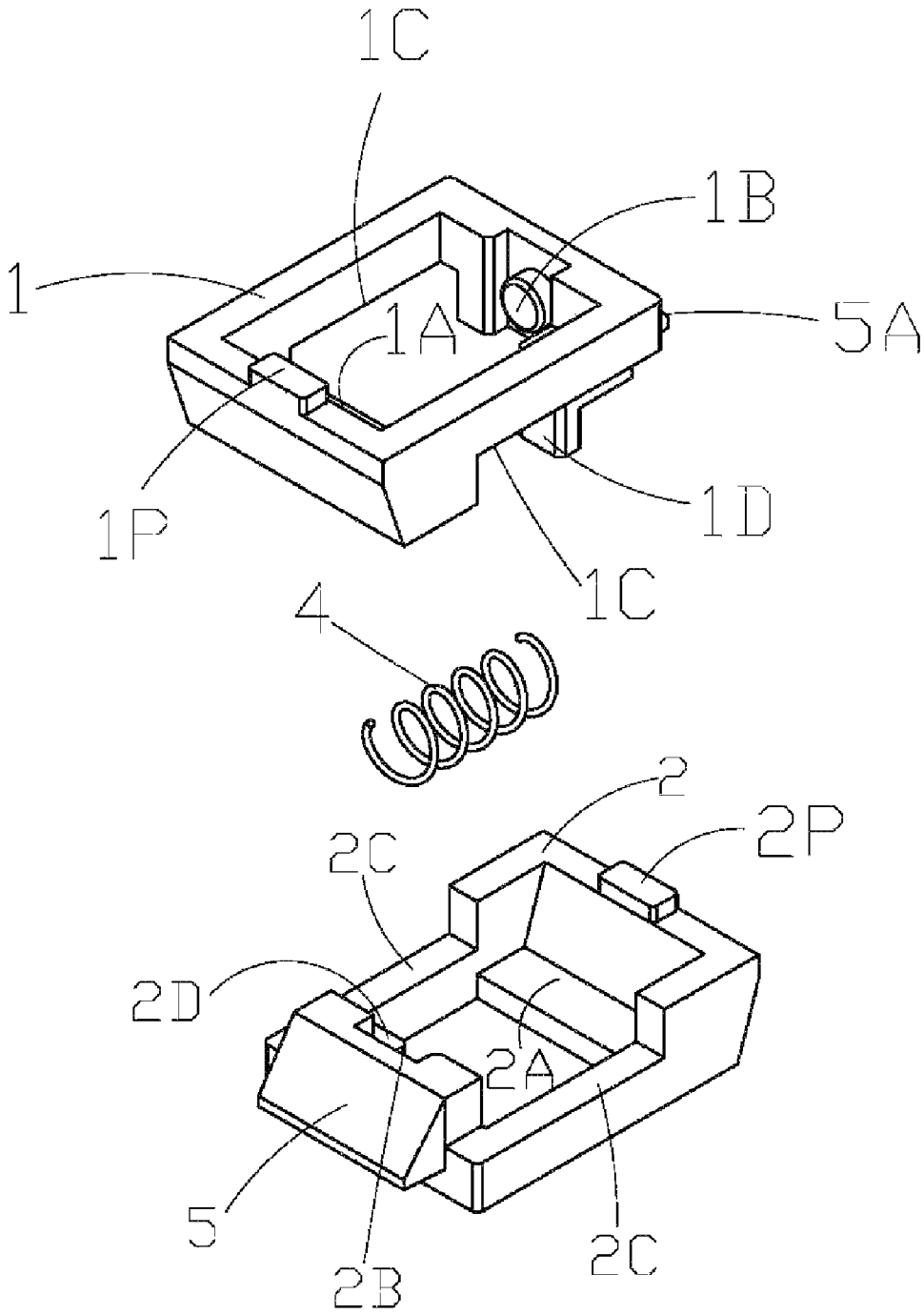
FIG. 2B is an example of a schematic structural diagram of Implementation Example 1.

FIGS. 2A and 2B are structural diagrams of Implementation Example 1. As shown in FIGS. 1, 2A and 2B, the power outlet socket safety shield device installed in the power outlet includes left slider 1, right slider 2 and elastic element 4. The left slider 1 and the right slider 2 are intercrossed integrally together, or are assembled together with their heads and tails crossed and with the bracket bodies overlapped. They are located between the hot sockets 361 and neutral sockets 362 at the power outlet surface and the hot conductive socket 321 and the neutral conductive socket 331 inside the outlet. After the left slider 1 and the right slider 2 are assembled together, an elastic element 4 is placed between the left slider 1 and the right slider 2.

When a power plug is not inserted into the power outlet, the left slider 1 and the right slider 2 are relatively static, with the transverse baffle 1A and inclined stopper 5A on the left slider 1 and the transverse baffle 2A and the inclined stopper 5 on the right slider 2 fitted to cover the hot conductive socket 321 and the neutral conductive socket 331 below them, keeping the power sockets at the power outlet surface in an enclosed protective state. In the process of inserting the power plug into the power outlet, left slider 1 and right slider 2 move to expose the hot conductive socket 321 and the neutral conductive socket 331 below it, so that the power sockets at the power outlet surface are open, allowing the power plug to be inserted into the power outlet. When the power plug is pulled out of the power outlet, under the action of the elastic element 4, left slider 1 and right slider 2 return to the initial position, and the transverse baffle 1A and inclined stopper 5A of the left slider 1 and the inclined stopper 5 and transverse baffle 2A of the right slider 2 cover the hot conductive socket 321 and the neutral conductive socket 331 below them again. The power sockets at the power outlet surface are in an enclosed protective state again.

As shown in FIGS. 2A and 2B, the left slider 1 is a quadrilateral shape, preferably a box or square shape, with its bottom hollowed. A transverse baffle 1A is provided inside the left side wall of the left slider 1, and an inclined stopper 5A is provided outside the right side wall of the left slider 1A.

The right slider 2 is a quadrilateral shape, preferably a box or square shape, with its bottom hollowed. An inclined stopper 5 is provided outside the left side wall of the right slider 2, and a transverse baffle 2A is provided inside the right side wall of the right slider 2.

The inclination direction of the inclined stopper 5A of the left slider 1 is contrary to that of the inclined stopper 5 of the right slider 2. When a power plug is not inserted into the power outlet, the left and right sliders 1 and 2 are assembled touching together. The inclined stopper 5A of the left slider 1 is placed over the transverse baffle 2A of the right slider 2, while the inclined stopper 5 of the right slider 2 is placed over the transverse baffle 1A of the left slider 1. The stoppers 5 and 5A and transverse baffles 1A and 2A are fitted to cover the hot conductive socket and neutral conductive socket below them.

When a power plug is inserted into the power outlet by force, the power plug pins act on the inclined stoppers 5 and 5A of the left and right sliders 1 and 2. Due to the contrary inclination direction of the stoppers 5 and 5A, the power plug pins push the left slider 1 and the right slider 2 to move to the opposite directions, exposing the hot conductive socket and the neutral conductive socket below them and allowing the power plug to be inserted into the power outlet.

As shown in FIGS. 2A and 2B, in the inner wall of the left slider 1, a fixing point 1B is provided for fixing the elastic element 4. Symmetrically, in the inner wall of the left slider 2, a fixing point 2B is provided for fixing the elastic element 4. When the left slider 1 and the right slider 2 are assembled together, the elastic element 4 is placed between the left slider 1 and the right slider 2.

When a power plug is not inserted into the power outlet, the elastic element 4 is in a free state. When a power plug is inserted into the power outlet by force, the elastic element 4 is compressed. When the power plug is pulled out of the power outlet, the compressed elastic element 4 is released, pushing the left slider 1 and the right slider 2 to the initial position, covering the hot conductive socket and the neutral conductive socket below them.

To enable the left slider 1 and right slider 2 to be fixed in the middle frame 35 of the power outlet and to enable them to move along a set direction, at least one group of guide blocks are provided on the left slider 1 and the right slider 2. As shown in FIGS. 2A and 2B, a guide block 1P is provided at the top of the side wall of the left slider 1 and a guide block 2P is provided at the top of the side wall of the right slider 2. As shown in FIG. 1, two long slideways 36B are provided in the power outlet enclosure 36. The guide blocks 1P and 2P of the left slider 1 and the right slider 2 are embedded in the long slideways 36B, allowing the left and right sliders 1 and 2 to move along the set direction.

A fixing post 1D is provided at the bottom of the left slider 1, and a fixing post 2D is provided at the bottom of the right slider 2. The fixing posts 1D and 2D are used to secure the assembled left and right sliders 1 and 2 to the position 34 at the middle frame 35 of the power outlet so that, though the left and right sliders move, they are always located in the position 34 at the middle frame 35.

To allow the left slider 1 and the right slider 2 to be assembled together with the heads and tails crossed and with the bracket bodies overlapped, a groove 1C is provided at the lower part of the front and rear beams of the left slider 1. Similarly, a groove 2C is provided at the upper part of the front and rear beams of the right slider 2.

Figure 3B:
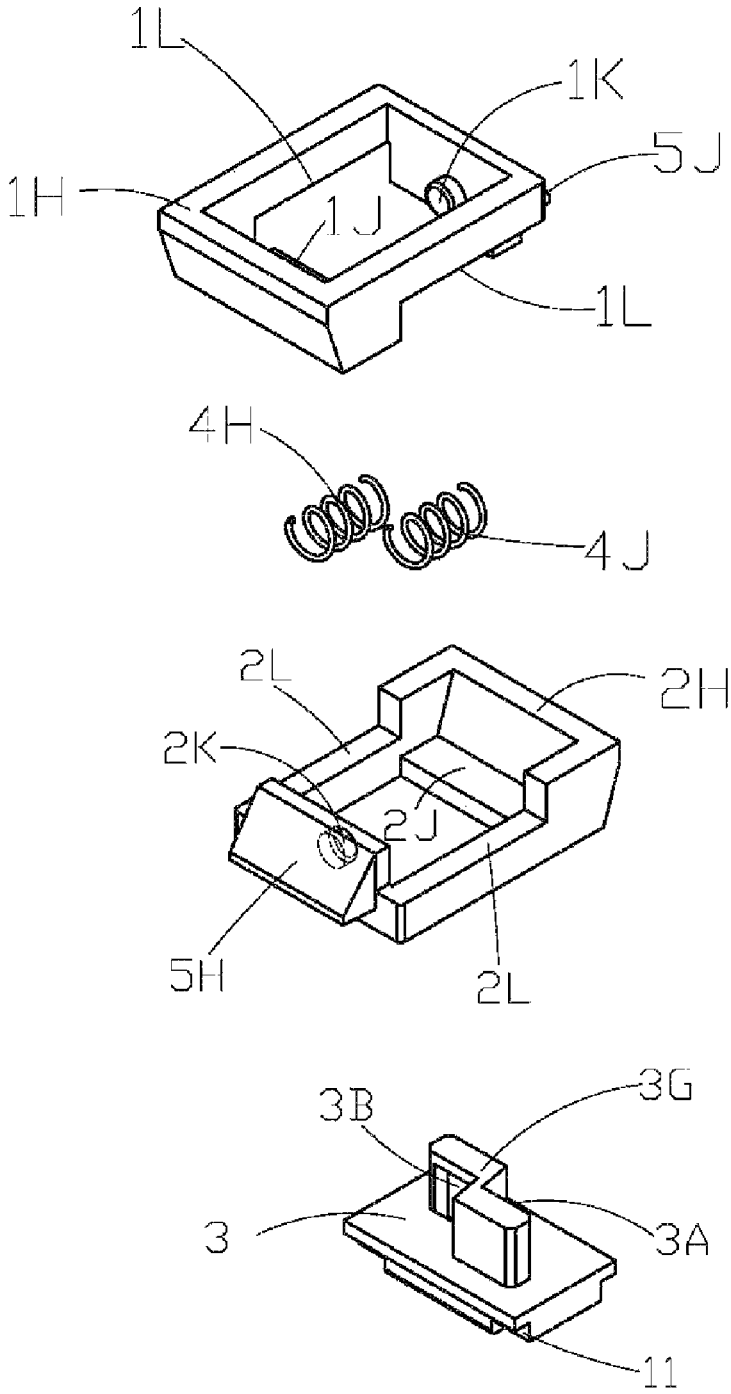
FIG. 3B is an example of a schematic structural diagram of Implementation Example 2.

FIGS. 3A and 3B are the structural diagram of Implementation Example 2. As shown in FIGS. 3A and 3B, the differences between Example 1 and Example 2 of this utility model is that Implementation Example 2 of this utility model includes two elastic elements 4H and 4J, omits the guide blocks 1P and 2P and the fixing posts 1D and 2D provided on the left and right sliders, and adds a supporting bracket 3.

After the left slider 1H and the right slider 2H are intercrossed integrally together, or are assembled together with the heads and tails crossed and with the bracket bodies overlapped, the supporting bracket 3 is placed within the area enclosed by the left and right sliders. On the supporting bracket 3, a fixing block 3G is provided for securing the elastic element 4H and 4J. To the two sides of the fixing block 3G, groove and tongue combinations 3A and 3B are provided respectively. After the left slider 1H and the right slider 2H are assembled together, an elastic element 4J is placed between the left slider 1H and the fixing block 3G of the supporting bracket 3, while an elastic element 4H is placed between the right slider 2H and the fixing block 3G of the supporting bracket 3. The two elastic elements 4H and 4J are positioned side by side in a staggered way. When the left and right sliders move to contrary directions, the two elastic elements 4H and 4J are compressed to the contrary directions.

The function of the fixing block 3G in this implementation example is: for fixing the elastic elements 4H and 4J; for preventing the left and right sliders from separating from each other during the sliding; and for fixing the left-right position.

As shown in FIGS. 3A and 3B, the fixing post 11 is provided at the bottom of the supporting bracket 3. The fixing post 11 is installed in the position 34 of the middle frame 35 of the power outlet.

The left slider, right slider and supporting bracket in this implementation example are dielectric parts.

Figure 4:
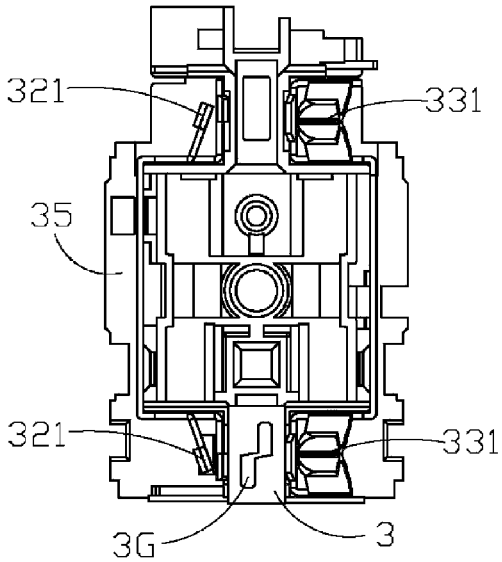
FIG. 4 is an example of an internal structural diagram of a power outlet without a power outlet socket safety shield device installed.
Figure 5:
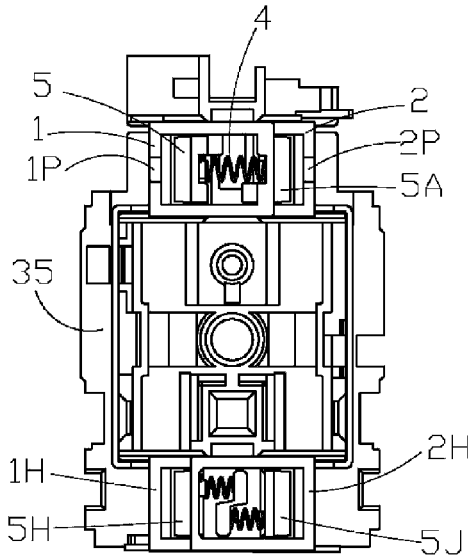
FIG. 5 is an example of a power outlet with power outlet socket safety shield devices of Implementation Examples 1 and 2 installed and in a static state, where the conductive sheet metals are covered.
Figure 6:
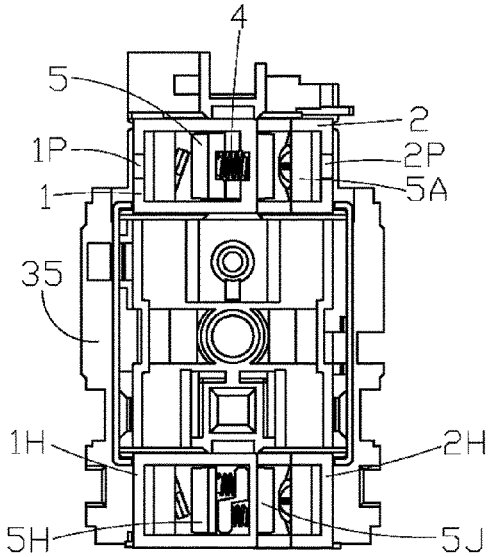
FIG. 6 is an example of a power outlet with power outlet socket safety shield devices of Implementation Examples 1 and 2 installed and in an active state, where the conductive sheet metals are uncovered.

FIGS. 4 through 6 are the internal structural diagrams of a power outlet with and without the power outlet socket safety shield device installed.

As shown in FIGS. 5 and 1, as an example of a possible implementation, the power outlet socket safety shield device of Implementation Example 1 is installed at the upper part of the power outlet, corresponding to a group of power sockets at the upper part of the power outlet. The power outlet socket safety shield device of Implementation Example 2 is installed at the lower part of the power outlet, corresponding to a group of power sockets at the lower part of the power outlet. In the alternative, a power outlet may comprise exclusively either the power outlet socket safety shield devices of Implementation Example 1 or 2.

As shown in FIGS. 4 and 1, for the assembly, the supporting bracket 3 of Implementation Example 2 is placed above the middle frame 35 of the power outlet, allowing the fixing post 11 of the supporting bracket 3 to be clamped in the position 34 of the middle frame 35.

As shown in FIG. 5, after the left and right sliders are assembled with the elastic element, they are placed inside the power outlet, covering the hot conductive socket and the neutral conductive socket below them.

As shown in FIG. 5, when the power plug is not inserted in the power outlet, as the inclined stoppers and transverse baffles of the left and right sliders cover the hot conductive socket and the neutral conductive socket below them, all the power sockets are in an enclosed protective state and it is impossible to see or touch the hot and neutral output conductive sockets through the hot socket and neutral socket on the power outlet surface. Even if a child or adult touches the power sockets or inserts small metal bars into the power sockets, no electroshock casualty accidents will occur. So, the power outlet sockets are very safe.

As shown in FIG. 6, when a power plug is inserted into the power sockets by force, under the action of the power plug pins, the left slider and the right slider will slide. During the sliding, the hot conductive socket and the neutral conductive socket below them are exposed, allowing the hot pins and the neutral pins on the power plug to be inserted into the hot conductive socket and the neutral conductive socket below them and allowing the power plug to be inserted into the power outlet completely to be supplied power.

When the power plug is pulled out of the power outlet, under the action of the respective at least one elastic element, the left and right sliders will return to the initial positions, covering the hot conductive socket and the neutral conductive socket below them, and reinstating all the power output sockets to enclosed protective states again. Even if a child or adult touches the power sockets or inserts small metal bars into the power sockets, they will not touch the conductors in the sockets, and subsequently no electroshock casualty accidents will occur, guaranteeing safety.

The advantage of the power outlet socket safety shield devices is that they can effectively prevent electroshock casualty accidents caused by people's touching of the conductive sheet metal through the power sockets at the power outlet surface, and so they are very safe.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A power outlet socket safety shield device, comprising:

a left slider comprising an inside side wall on one end and an outside side wall on an opposite end, the inside side wall comprising a left transverse baffle and the outside side wall comprising a left inclined stopper;

a right slider comprising an inside side wall on one end and an outside side wall on an opposite end, the inside side wall comprising a right transverse baffle and the outside side wall comprising a right inclined stopper; and at least one elastic element positioned between the left slider and the right slider, wherein the left inclined stopper is inclined in a direction opposite to the inclination of the right inclined stopper, wherein, when the power outlet socket safety shield device is in a rest state, the left inclined stopper is above the right transverse baffle and the right inclined stopper is above the left transverse baffle, and wherein, when the power outlet socket safety shield device is in an active state, the elastic element is compressed, the left slider and the right slider are moved in opposite directions to displace the left inclined stopper away from the right transverse baffle and to displace the right inclined stopper away from the left transverse baffle.

2. The device of claim 1, wherein:

the left slider further comprises a bottom and a left fixing post on its bottom; and the right slider further comprises a bottom and a right fixing post on its bottom, wherein the left fixing post and the right fixing post are configured to fix to a position on a middle frame of a power outlet.

3. The device of claim 1, wherein the left slider and the right slider comprise a dielectric material.

4. The device of claim 1, wherein:

the left slider further comprises a left top face on its inside side wall and at least one left guide block at the left top face; and the right slider further comprises a right top face on its inside side wall and at least one right guide block at the right top face, wherein the left guide block and the right guide block are configured to embed into a long slideway of a power outlet enclosure.

5. The device of claim 4, wherein:

the left slider further comprises a bottom and a left fixing post on its bottom; and the right slider further comprises a bottom and a right fixing post on its bottom, wherein the left fixing post and the right fixing post are configured to fix to a position on a middle frame of the power outlet.

6. The device of claim 4, further comprising a supporting bracket with a surface and a protruding fixing block on the surface of the supporting bracket, wherein, when the left slider and the right slider are overlapped, an enclosed space is formed, and the supporting bracket and the protruding fixing block are located within the area enclosed by the left slider and the right slider.

7. The device of claim 1, further comprising a supporting bracket with a surface and a protruding fixing block on the surface of the supporting bracket, wherein, when the left slider and the right slider are overlapped, an enclosed space is formed, and the supporting bracket and the protruding fixing block are located within the area enclosed by the left slider and the right slider.

8. The device of claim 7, wherein the protruding fixing block comprises a right side with a groove and tongue configuration and a left side with a groove and tongue configuration, and wherein a first elastic element of the at least one elastic element is located between the left slider and the left side, a second elastic element of the at least one elastic element is located between the right slider and the right side, and the first elastic element is parallel to and staggered along side the second elastic element.

9. The device of claim 8, wherein the supporting bracket comprises a bottom surface and a fixing post on the bottom surface, and the fixing post is configured to fix the left slider and the right slider to a position on a middle frame of a power outlet.

10. The device of claim 8, wherein the supporting bracket comprises a dielectric material.

11. The device of claim 8, wherein the left slider and the right slider comprise a dielectric material.

12. The device of claim 6, wherein the protruding fixing block comprises a right side with a groove and tongue configuration and a left side with a groove and tongue configuration, and wherein a first elastic element of the at least one elastic element is located between the left slider and the left side, a second elastic element of the at least one elastic element is located between the right slider and the right side, and the first elastic element is parallel to and staggered along side the second elastic element.

13. The device of claim 12, wherein the supporting bracket comprises a bottom surface and a fixing post on the bottom surface, and the fixing post is configured to fix the left slider and the right slider to a position on a middle frame of a power outlet.

14. The device of claim 12, wherein the supporting bracket comprises a dielectric material.

15. The device of claim 12, wherein the left slider and the right slider comprise a dielectric material.

* * * * *